United States Patent [19]

Pettingell et al.

[11] Patent Number: 4,482,391

[45] Date of Patent: Nov. 13, 1984

[54] CLEANING METHOD AND APPARATUS FOR PARABOLIC CELLULAR LOUVERS FOR LIGHTING FIXTURES

[75] Inventors: Winslow L. Pettingell, Wood Dale; John F. Hall, Addison, both of Ill.

[73] Assignee: Foam Cutting Engineers, Inc., Addison, Ill.

[21] Appl. No.: 447,391

[22] Filed: Dec. 6, 1982

[51] Int. Cl.[3] ..... B08B 1/02; A47L 25/00

[52] U.S. Cl. ..... 134/6; 15/97 R; 15/103.5; 15/230.14; 15/230.16; 134/8; 134/9

[58] Field of Search ..... 15/97 R, 98, 103.5, 15/230, 230.11, 230.16, 230.14, 230.1, 230.18; 29/121.1, 121.2, 121.5, 121.6, 121.7, 124, 132; 134/6, 8, 9

[56] References Cited

U.S. PATENT DOCUMENTS

| | | | |
|---|---|---|---|
| 2,187,585 | 1/1940 | Grigas | 401/14 |
| 2,287,768 | 6/1942 | Eckstein | 29/121.2 X |
| 2,761,167 | 9/1956 | Bridgford | 15/244 A |
| 2,843,869 | 7/1958 | Hermance | 15/230.11 |
| 2,866,995 | 1/1959 | Evensen | 15/230.11 |
| 2,929,088 | 3/1960 | Wier, Jr. | 15/230.16 |
| 3,054,381 | 9/1962 | Meichtry | 118/249 |
| 3,448,479 | 6/1969 | Cademartori | 15/230.11 |

*Primary Examiner*—Edward L. Roberts
*Attorney, Agent, or Firm*—Wood, Dalton, Phillips, Mason & Rowe

[57] ABSTRACT

An apparatus for cleaning a lighting fixture louver of the type which has parabolic cells that are open top and bottom. A cleaning roller of a graft polyol polyether urethane having an indentation load deflection of the order of 100 has a surface which consists of circumferentially discrete rows of individual cleaning lugs, and each row has enough lugs to clean an entire row of cells in a louver module, with a longitudinal and circumferential lug pitch equal to the pitch of the louver cells. Each cleaning lug has a perimetrical surface that may scrub the surface of the entire wall means of a cell, and has a radial depth slightly greater than the louver depth. The cleaning roller is journalled atop a cleaning liquid tank with its lower portion in the liquid, and a pressure roller surmounts the cleaning roller to press a louver onto the cleaning roller with a row of louver cells fully engaged with the row of cleaning lugs at the top of the roller. Rotation of the cleaning roller drives the louver endwise between the cleaning and pressure rollers. Drain pans return liquid that flows off the louver back into the tank.

20 Claims, 5 Drawing Figures

5
15
26
27
25
36
13
40
38
14
23
28
24
36
22
41
38
40
39
29
18
19
5

15
27
12
46
W
R
R
W
L
R
C
C
C
13
10
35
38
35
32
32
24
16
31
31
16
36
S
21
21
11

CLEANING METHOD AND APPARATUS FOR PARABOLIC CELLULAR LOUVERS FOR LIGHTING FIXTURES

BACKGROUND OF THE INVENTION

A very popular louver for fluorescent lighting fixtures and so-called "luminous ceilings" is known as a parabolic louver because the louver cells, which are open top and bottom, have walls which are parabolically curved from top to bottom. Parabolic louvers are made either with square cells or with circular cells supported in a square grid.

The parabolic louvers are popular not only because they are quite decorative, but also because they are the most efficient open louvers yet devised for distributing illumination uniformly over an area. They have been installed in many new or redecorated buildings, and may be found in lobby areas, elevator cars, and any other locations where their advantages may be desired.

Parabolic louvers have turned out to have one very serious practical drawback. The parabolic cell walls must be kept very clean of any dust or film that would interfere with their light reflective properties; and cleaning the cells has turned out to be a very slow and tedious hand operation.

The companies that manufacture and distribute parabolic louvers have tried for some time to develop a relatively rapid and simple and inexpensive way to clean the louvers, and one of the manufacturers entered into a contract with an independent research facility in an effort to solve the problem which was beginning to interfere with the marketability of parabolic louvers. Neither the manufacturers nor the independent research facility was successful in these endeavors, although the research facility was successful in developing a cleaning liquid which does a very superior job of removing dust and smoke film from louver cell walls.

The problems presented in caring for parabolic louvers are well illustrated by the cleaning instructions published by one manufacturer, which read as follows:

> "Parabolic louvers, though extremely durable should be maintained with mild detergents, rinsed thoroughly with deionized warm clean water (not more than 120°) and air dried. Never use abrasives or mechanical means for cleaning the specular surfaces of these louvers."

SUMMARY OF THE INVENTION

The present invention comprises mechanical means for safely and thoroughly cleaning the specular surfaces of parabolic louvers. A prototype of the invention has been used experimentally to clean such louvers, and it has been demonstrated that it completely cleans the specular surfaces without damaging them in any way.

In accordance with the invention, apparatus for cleaning a parabolic louver comprises a cleaning roller the surface of which consists of circumferentially discrete longitudinal rows of individual cleaning lugs, the longitudinal and circumferential lug pitch being equal to the pitch of the louver cells, and each lug having a radial depth slightly greater than the louver depth and having a perimetrical surface such that the lug may scrub the surface of the entire wall means of a cell as it rolls through the cell.

A preferred material for fabricating the cleaning roller is a graft polyol polyether urethane foam which has an indentation load deflection of the order of 100. The material is porous enough to pick up cleaning liquid from a tank in which the lower part of the roller is immersed and transfer a cleaning liquid to the louver cell walls, the material is stiff enough to thoroughly scrub the surface of the entire wall means of a cell as the cleaning lug rolls through the cell, and yet is of such a nature that it does not abrade or otherwise damage the specular surfaces.

Although the apparatus has been successfully used for the experimental cleaning of parabolic louvers with a cleaning roller that is built like a rolling pin so that it may be manually rolled from end to end of a louver that is placed upside down upon a support, the preferred apparatus includes a base, a cleaning liquid supply tank extending transversely of the base, means surmounting the tank to journal the cleaning roller with its lower portion immersed in a cleaning liquid in the tank, rail means on the base to support a louver for engagement by the upper portion of the cleaning roller, and a pressure roller surmounting the cleaning roller to press a louver onto said cleaning roller with a row of louver cells fully engaged with the row of cleaning lugs at the top of the roller, whereby the cleaning roller may be rotated to constantly transfer cleaning liquid from the tank to the louver and to progressively clean successive rows of cells by the scrubbing action of successive rows of the cleaning lugs.

Conveniently, a pair of arms is pivoted about the axis of the cleaning roller, and the pressure roller is journalled at the free ends of the arms about an axis which is spaced from the cleaning roller axis by the sum of the radii of the cleaning roller and the pressure roller; and the means for rotating the cleaning roller is a hand crank.

In order that the apparatus may be readily portable so as to be moved from place to place where there are parabolic louvers that require cleaning, it is preferred that the base comprise legs supporting the cleaning liquid supply tank with the means to journal the cleaning roller about at table height, a pair of drain pans which detachably hook onto opposite sides of the tank and carry the rail means, and folding legs on each drain pan supporting said pans to drain liquid back into the supply tank, said drain pans with the legs folded and said liquid supply tank and rollers all being readily manually portable and of dimensions to fit readily into a passenger automobile.

In using the apparatus, the cleaning roller and louver are pressed together with the row of cleaning lugs at the top of the roller thrust entirely into a row of cells at one end of the louver, and then by rotating the cleaning roller while the pressure roller continues to press the roller and louver together, successive rows of cleaning lugs are thrust entirely into successive rows of cells, so that all the cells in a louver are scrubbed one row at a time.

THE DRAWINGS

DETAILED DESCRIPTION OF THE INVENTION

Figure 1:
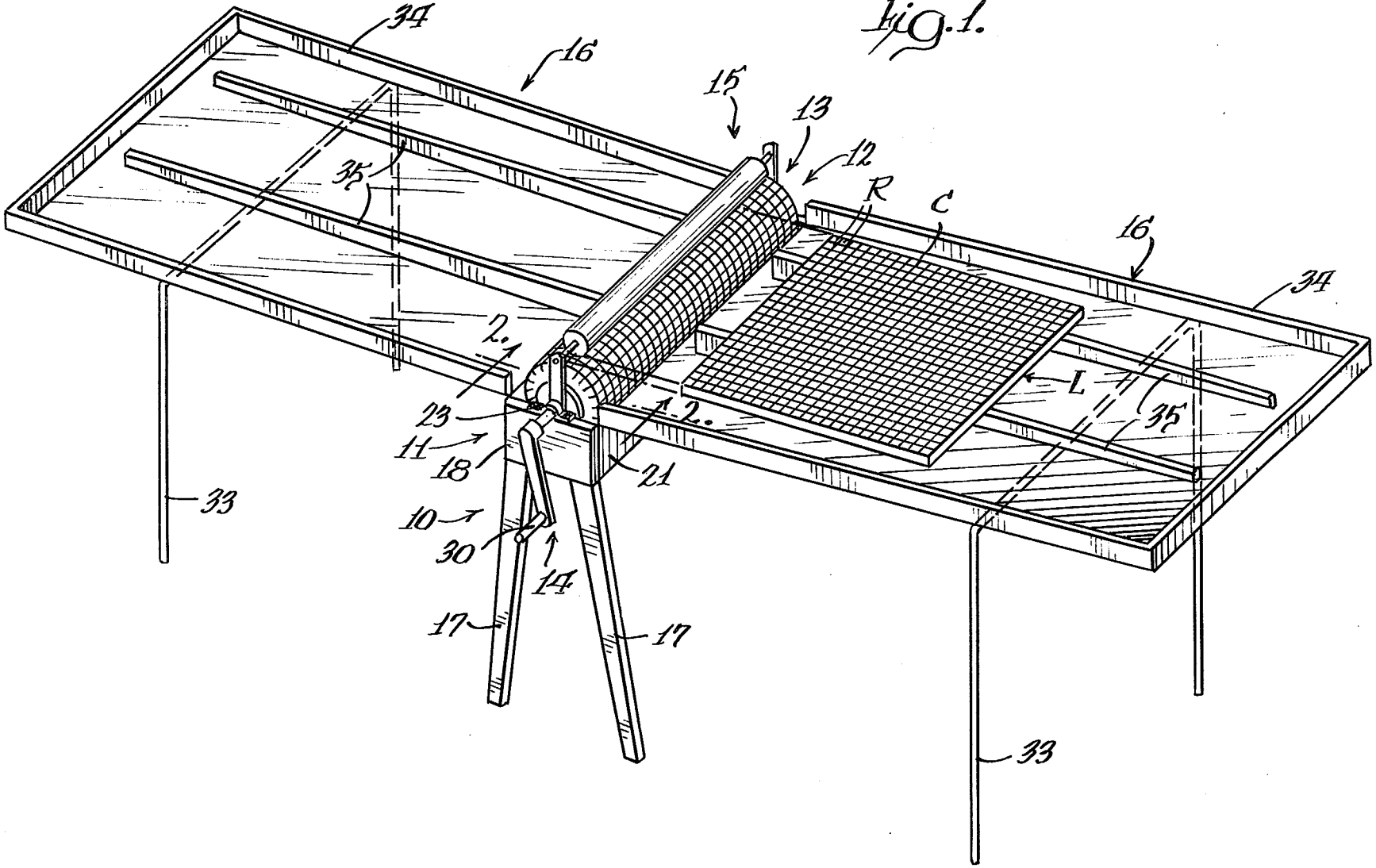
FIG. 1 is a perspective view of a preferred embodiment of the apparatus of the invention with a louver module on the support rails adjacent the cleaning roller.

Referring to the drawings, and referring first to FIG. 1, the apparatus of the present invention consists of a base, indicated generally at 10; a cleaning liquid supply tank, indicated generally at 11; an assembly of cooperating rollers, indicated generally at 12, that includes a cleaning roller, indicated generally at 13, means indicated generally at 14 for rotating the cleaning roller, and a pressure roller, indicated generally at 15; and drain pan assemblies, indicated generally at 16.

Figure 5:
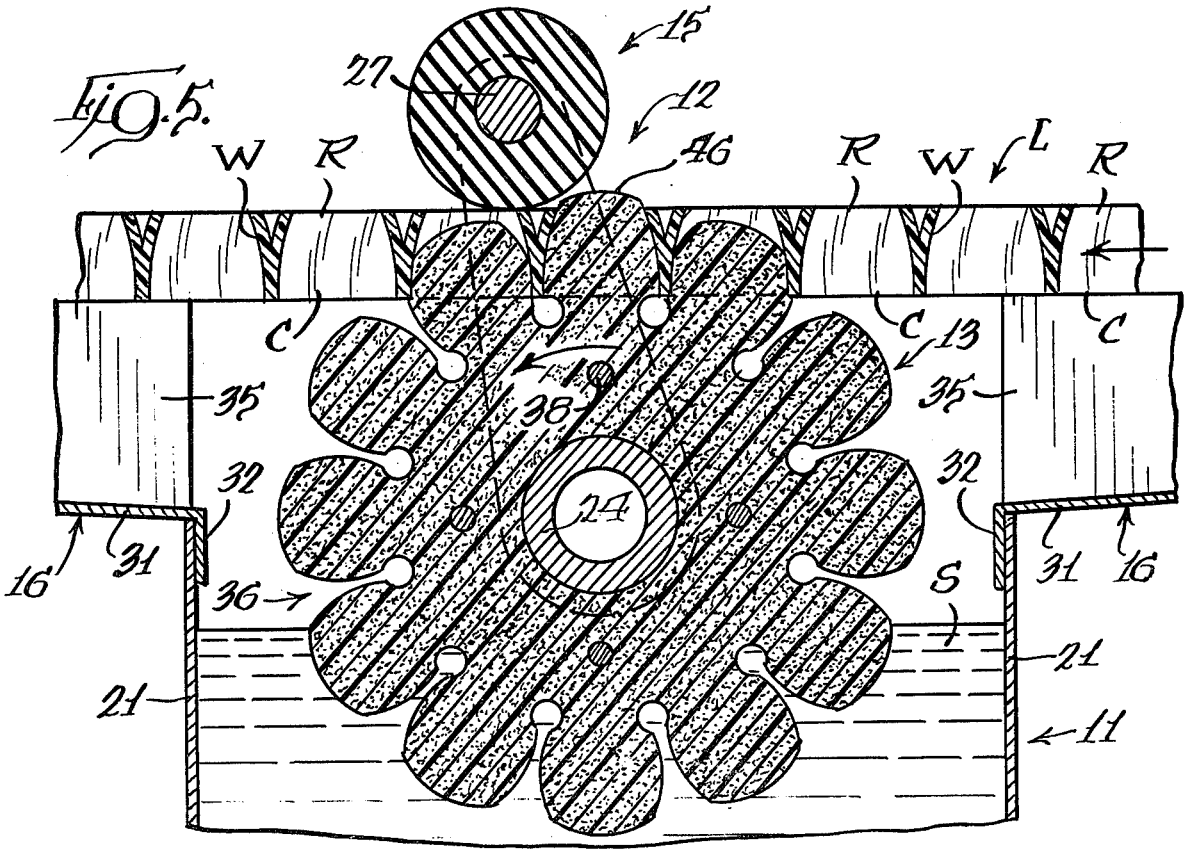
FIG. 5 is a fragmentary sectional view taken substantially as indicated along the line 5—5 of FIG. 4 with a rectangular cell parabolic louver part way through the apparatus.

Referring to FIGS. 1 and 5, the devices which the apparatus is particularly constructed to clean consist of modular parabolic louvers, one of which is indicated generally at L, and each such louver consists of a plurality of parallel rows R of cells C. Each cell is defined by parabolically curved wall means W which, in the particular type of louver illustrated in the drawings, consists of four walls at right angles to each other which define a square cell.

A typical commercially available louver of the type illustrated in the drawings is one inch (25.4 mm) thick and has cells which are 1.5 inch (38.1 mm) square. Typically, the modular louvers are available in four foot lengths (121.92 cm) and widths of one foot (30.48 cm) or two feet (60.96 cm).

Figure 2:
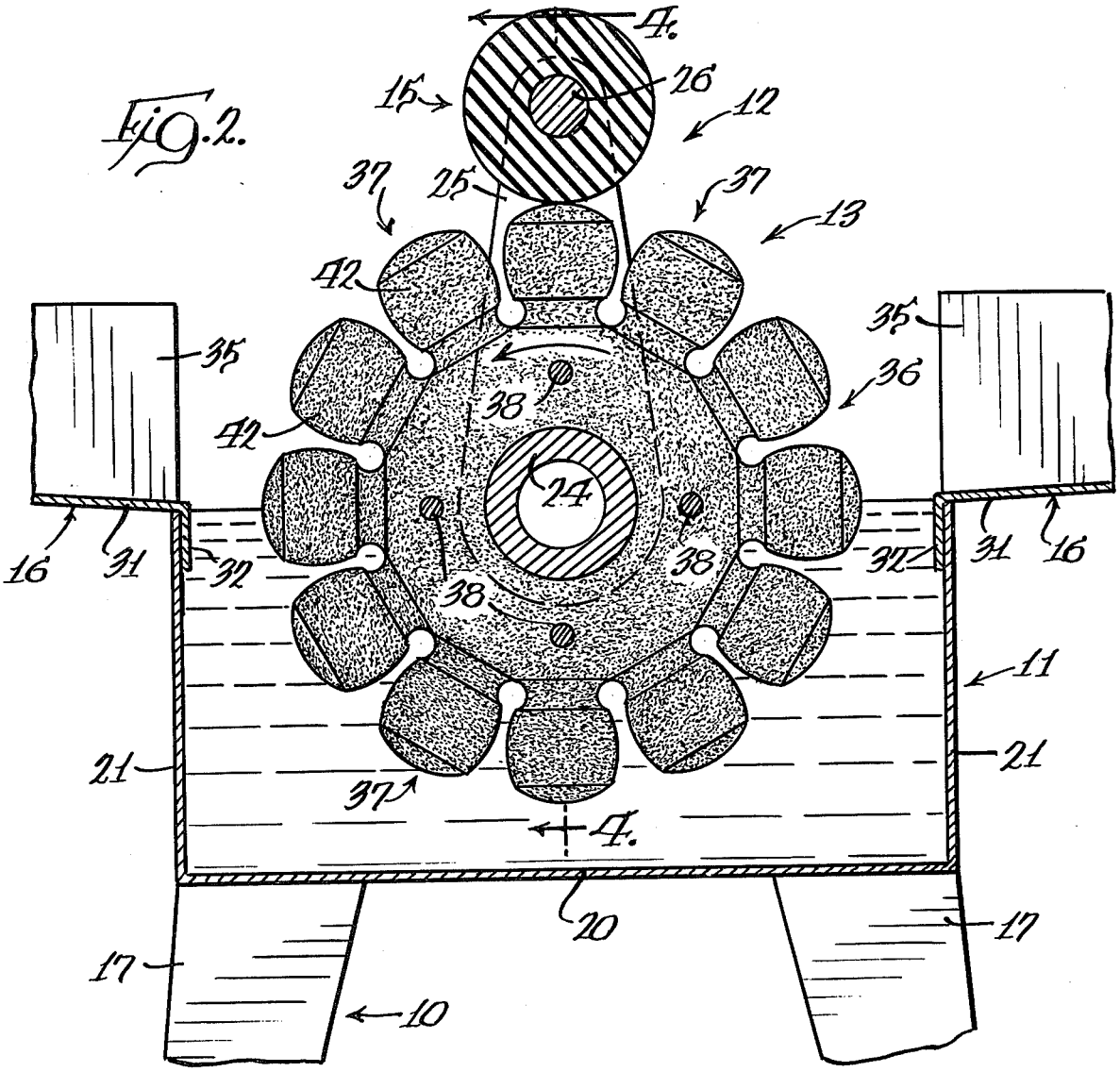
FIG. 2 is a fragmentary sectional view on an enlarged scale taken substantially as indicated along the line 2—2 of FIG. 1.
Figure 4:
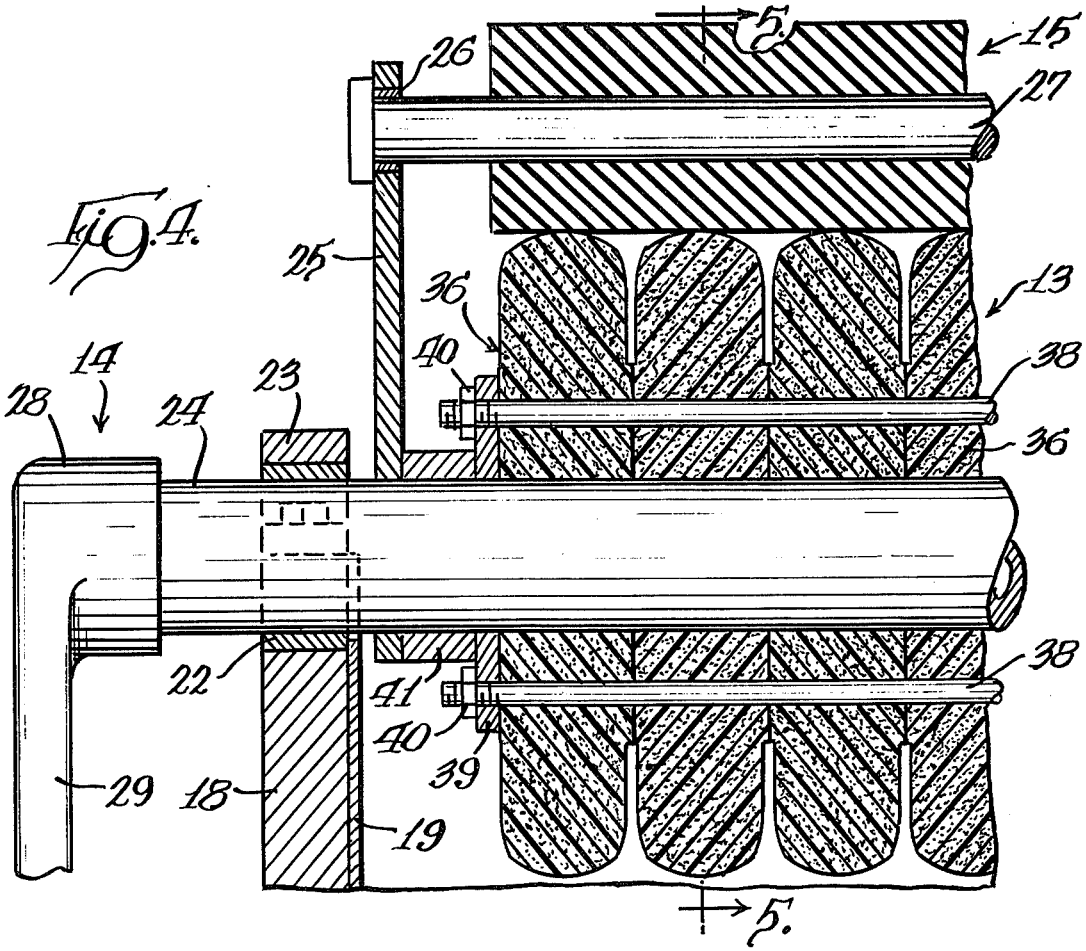
FIG. 4 is a fragmentary sectional view taken substantially as indicated along the line 4—4 FIG. 2.

Referring now particularly to FIGS. 1 and 2, the base 10 consists of a set of four legs 17 which support end panels 18; and the tank 11 is of sheet metal with end walls 19 confined between the end panels 18 of the base, a bottom wall 20 and transverse side walls 21. Surmounting the end panels 18 are journals 22 which are held down by mounting straps 23 (see FIG. 4).

Rotatably mounted in the journals 22 is an axle 24 for the cleaning roller 13, and rotatable about the axle 24 is a pair of mounting arms 25 in the free ends of which are bushings 26 in which are journalled a spindle 27 for the pressure roller 15. On one end of the cleaning roller axle 24 is a hollow mounting boss 28 on which is a crank arm 29, and at the free end of the crank arm is a crank handle 30.

Each of the drain pans 16 consists of a bottom panel 31 having a transverse flange 32 that hooks over one of the tank side walls 21, and each of the drain pans is equipped with a pair of folding legs 33 the lengths of which are such that the drain pans 16 are tilted to drain cleaning liquid back into the tank 11. Each drain pan has a peripheral wall 34 around three sides, and a pair of longitudinal rails 35 which are seen in FIG. 5 to support a louver L at the correct height for passage between the cleaning roller 13 and the pressure roller 15.

The cleaning roller 13 consists of a line of cleaning lug discs, indicated generally at 36, each of which has twelve cleaning lugs, indicated generally at 37, about its periphery. The discs 36 have aligned bores to receive assembly rods 38 which extend completely through the cleaning lug discs and through pressure plates 39, and which have threaded extremities to receive nuts 40. Spacer collars 41 surround the cleaning roller axle 24 between the pressure plates 39 and the mounting arms 25 for the pressure roller 15.

The assembly of the cleaning lug discs 36 on the axle 24 provides circumferentially discrete longitudinal rows of cleaning lugs, and each row is at least as long as a row of cells in a modular louver. The distance between radii through the centers of adjacent cleaning lugs is herein referred to for convenience as the lug pitch, and the distance between the vertical center lines through adjacent cells C of a louver L is defined for convenience as the louver cell pitch. Those two pitches are equal both lengthwise along a row of cleaning lugs 37 and circumferentially between adjacent cleaning lugs 37 on a single cleaning lug disc 36.

Figure 3:
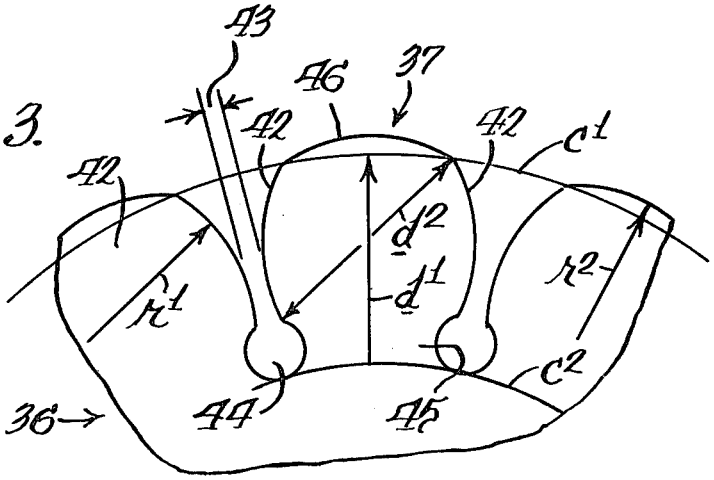
FIG. 3 is a fragmentary side elevational view of a cleaning lug and parts of two adjacent cleaning lugs, drawn at full scale for an apparatus to clean a one inch deep (25.4 mm) louver with one and one-half inch (38.1 mm) square parabolic cells.

Referring to FIGS. 3 and 5, each cleaning lug 37 has arcuate faces 42 on all four sides, and there is a space 43 between adjacent cleaning lugs, both longitudinally along the rows and circumferentially of a single cleaning lug disc 36, which is substantially the same as the thickness of the cell walls W, and at the radially inner end of each inter lug space 43 is an enlarged opening 44 so that each cleaning lug has a reduced neck 45 that gives it considerable flexibility in all directions. Each cleaning lug 37 has an arcuate outer end face 46. Each of the lugs 37 has a radial depth which is slightly greater than the louver depth, so that, as seen in FIG. 5, a cleaning lug may extend entirely through a cell C from bottom to top.

Referring further to FIG. 3, the dimensions and significant radii of a cleaning disc 13 for cleaning a one inch (25.4 mm) louver having 1.5 inch (38.1 mm) square parabolic cells are as follows:

The radius from the center of the axle 24 to a circle c1 is 3 9/16 inches (90.4875 mm).

The radius of a circle c2 is 2 3/16 inches (55.5626 mm).

A distance d1 is 1 3/8 inches (34.925 mm).

A distance d2 is 1.5 inches (38.1 mm).

A radius r1 is 1 3/16 inches (30.1625 mm).

A radius r2 is one inch (25.4 mm).

The space 43 between lugs is ⅛ inch.

The radius of the enlarged openings 44 is 3/16 inch (4.7625 mm).

It is quite apparent that there is nothing critical about the diameter of the pressure roller 15. The arms 25 upon which the pressure roller 15 is journalled provide a length from the axis of the cleaning roller axle 24 to the axis of the pressure roller spindle 27 which is equal to the radius of the cleaning roller 13 plus the radius of the pressure roller 15. Accordingly, the surface of the pressure roller 15 contacts the extremity of a cleaning lug 37 as seen in FIG. 2.

In use, the tank 11 is filled with a cleaning liquid S as indicated in FIG. 5 and the cleaning roller is rotated sufficiently to move the wet cleaning lugs to the top of the roller. A louver L is supported upon the rails 35 which are to the right as seen in the drawings, and the row of cells at the left-hand end of the louver is manually engaged with the row of cleaning lugs 37 which are at 1 o'clock as seen in FIG. 2. The crank is turned to rotate the cleaning roller 13 counterclockwise as indicated by the arrows in FIGS. 2 and 5, and the louver is manually held in engagement with the cleaning lugs 37 until it enters the nip of the rollers 13 and 15. Continued rotation of the cleaning roller with the louver engaged therewith swings the pressure roller 15 to the position seen in FIG. 5, and continued rotation of the cleaning roller drives the louver to the left as seen in FIG. 5 so that all the cells in the louver are thoroughly scrubbed by the cleaning lugs 37 one row at a time. Cleaning liquid S which runs off the louver cell walls W falls into the drain pan 16 and is returned to the supply in the tank 11.

The preferred material for the cleaning roller discs 36 is a foamed polyurethane which is fully elastic, such as a graft polyol polyether urethane. In order to have the desired characteristics for entering the cells and scrubbing the walls as they pass through the cells, the material of which the roller disc is formed should have an indentation load deflection of the order of 100.

Indentation load deflection is a standard index number which indicates the number of pounds required to produce a 25% indentation deflection of a 50 square inch plate—i.e., 1 inch deflection of a 4 inch thick pad of material. This is a relatively stiff material, but it is capable of compressing so that a cleaning lug 37 which completely fills a cell C can squeeze enough to get in and out as the cleaning roller rotates.

As indicated in the first paragraph of the specification, some parabolic louvers are made with circular cells supported in a square grid. It is apparent that the present type of apparatus could be used for cleaning such louvers, but that a cleaning roller of somewhat different characteristics would be required. The cleaning lugs would need to be of a different shape, and the space between cleaning lugs would need to be adjusted so as to provide a longitudinal and circumferential lug pitch equal to the pitch of the louver cells.

The foregoing detailed description is given for clearness of understanding only and no unnecessary limitations should be understood therefrom, as modifications will be obvious to those skilled in the art.

We claim:

1. Apparatus for cleaning a lighting fixture louver which has several rows of cells that are defined by parabolically curved wall means and that are open top and bottom, said apparatus comprising:

a cleaning roller the surface of which consists of circumferentially discrete longitudinal rows of individual cleaning lugs, the longitudinal and circumferential lug pitch being equal to the pitch of the louver cells with longitudinal and circumferential spacing between adjacent lugs substantially equal to the thickness of said cell walls, and each lug having a radial depth slightly greater than the louver depth and having arcuate perimetrical surfaces such that the lug may scrub the surface of the entire wall means of a cell as it rolls through the cell.

2. The apparatus of claim 1 in which the roller consists of a porous material the indentation load deflection of which is of the order of 100.

3. The apparatus of claim 2 in which the material is an elastic foamed polyurethane.

4. The apparatus of claim 3 in which the material is graft polyol polyether urethane.

5. The apparatus of claim 1 in which each row of cleaning lugs is substantially as long as a row of cells in a louver.

6. The apparatus of claim 1 which includes means for rotating the cleaning roller about its longitudinal axis.

7. The apparatus of claim 1 wherein each said lug has a neck of reduced size at its radially inner end.

8. The method of cleaning a lighting fixture louver which has several rows of cells that are defined by parabolically curved wall means and that are open top and bottom, said method comprising the successive steps of:

(a) providing a cleaning roller as defined in claim 1 and providing means for rotating said cleaning roller about its longitudinal axis;

(b) continuously wetting all the cleaning lugs with a cleaning liquid;

(c) pressing the cleaning roller and louver together with one row of cleaning lugs thrust entirely into a row of cells at one end of a louver; and (d) rotating the cleaning roller while continuously pressing said cleaning roller and louver together so that successive rows of cleaning lugs are thrust entirely into contiguous cells in successive rows of cells, whereby said contiguous cells in a louver are scrubbed one row at a time.

9. The method of claim 8 in which the cleaning roller axis is held in a fixed position and the louver is pressed downwardly onto the cleaning roller and is moved endwise by rotation of the roller.

10. The method of claim 9 in which the lugs of a cleaning roller are continuously wet with a cleaning liquid by so locating the cleaning roller axis above a pool of cleaning liquid that the lower portion of the cleaning roller is constantly immersed in said pool.

11. The method of claim 10 in which cleaning liquid carried into the louver cells by the cleaning lugs is drained back into the pool.

12. The method of claim 8 in which substantially all the cells in each row are scrubbed simultaneously.

13. Apparatus for cleaning a lighting fixture louver which has several rows of cells that are defined by parabolically curved wall means and that are open top and bottom, said apparatus comprising, in combination:

a base;

a cleaning liquid supply tank extending transversely of the base;

a cleaning roller journalled above said supply tank with its lower portion in the tank, said cleaning roller having a surface which consists of circumferentially discrete longitudinal rows of individual cleaning lugs, each of said rows being substantially as long as a row of cells in a louver, the longitudinal and circumferential lug pitch being equal to the pitch of the louver cells with longitudinal and circumferential spacing between adjacent lugs substantially equal to the thickness of said cell walls, and each lug having a radial depth slightly greater than the louver depth and having arcuate perimetrical surfaces such that the lug may scrub the surface of the entire wall means of a cell as it rolls through the cell;

rail means on the base to support a louver for engagement by the upper portion of the cleaning roller;

means for rotating said cleaning roller about its longitudinal axis;

and a pressure roller surmounting the cleaning roller to press a louver onto said cleaning roller with a row of louver cells fully engaged with the row of cleaning lugs at the top of the roller, whereby the cleaning roller may be rotated to constantly transfer cleaning liquid from the tank to the louver and to progressively clean successive rows of cells by the scrubbing action of successive rows of the cleaning lugs.

14. The combination of claim 13 which includes a pair of arms pivoted about the axis of the cleaning roller and journalling the pressure roller on an axis which is spaced from the cleaning roller axis by the sum of the radii of the cleaning roller and the pressure roller.

15. The apparatus of claim 14 in which the means for rotating the cleaning roller comprises a hand crank.

16. The apparatus of claim 13 in which the means for rotating the cleaning roller comprises a hand crank.

17. The apparatus of claim 13 in which the base comprises legs supporting the cleaning liquid supply tank with the means to journal the cleaning roller about at table height, a pair of drain pans which detachably hook onto opposite sides of the tank and carry the rail means, and folding legs on each drain pan supporting said pans to drain liquid back into the supply tank, said drain pans with the legs folded and said liquid supply tank and rollers all being readily manually portable and of dimensions to fit readily into a passenger automobile.

18. The apparatus of claim 13 in which the roller consists of a porous material the indentation load deflection of which is of the order of 100.

19. The apparatus of claim 18 in which the material is an elastic foamed polyurethane.

20. The apparatus of claim 19 in which the material is a graft polyol polyether urethane.

* * * * *